US005105718A

United States Patent [19]

Sprafke et al.

[11] Patent Number: 5,105,718

[45] Date of Patent: Apr. 21, 1992

[54] MANUALLY OPERATED WHEEL FOR ACTIVATING THE HATCH ON A COMBAT VEHICLE, ESPECIALLY A TANK

[75] Inventors: Uwe Sprafke, Schauenburg-Elmshagen; Michael Fehr, Wabern-Udenborn, both of Fed. Rep. of Germany

[73] Assignee: Wegmann & Co. GmbH, Kassel, Fed. Rep. of Germany

[21] Appl. No.: 614,534

[22] Filed: Nov. 15, 1990

[30] Foreign Application Priority Data

Nov. 21, 1989 [DE] Fed. Rep. of Germany ..... 3938588

[51] Int. Cl.[5] ..... F41H 5/22; F41H 7/04; B65D 90/10

[52] U.S. Cl. ..... 89/36.08; 114/117

[58] Field of Search ..... 89/36.08, 36.13; 114/201 R, 116, 117; 49/67; 109/64, 67, 68, 74

[56] References Cited

U.S. PATENT DOCUMENTS

| | | | |
|---|---|---|---|
| 2,476,471 | 7/1949 | Wilson | 114/117 |
| 2,488,796 | 11/1949 | Baier | 114/117 |
| 3,821,935 | 7/1974 | Adler | 114/201 R |
| 4,114,424 | 9/1978 | Johnson | 114/117 |
| 4,738,184 | 4/1988 | Böhne et al. | 89/36.08 |

*Primary Examiner*—David H. Brown

*Attorney, Agent, or Firm*—Sprung Horn Kramer & Woods

[57] ABSTRACT

A manually operated wheel for activating the hatch on a combat vehicle, especially a tank. It comprises an axially solid disk of appropriate anti-fragmentation and-/or anti-radiation material.

6 Claims, 3 Drawing Sheets

MANUALLY OPERATED WHEEL FOR ACTIVATING THE HATCH ON A COMBAT VEHICLE, ESPECIALLY A TANK

BACKGROUND OF THE INVENTION

The invention concerns a manually operated wheel for activating the hatch on a combat vehicle, especially a tank.

When anti-fragmentation and/or anti-radiation material is installed inside a tank, they take up a lot of space, especially underneath the hatch.

SUMMARY OF THE INVENTION

The object of the present invention is to install anti-fragmentation and/or anti-radiation material in the vicinity of the hatchway in a combat vehicle without occupying too much space.

This object is attained in accordance with the invention in that the manually operated wheel comprises an axially solid disk of appropriate anti-fragmentation and/or anti-radiation material.

The disk that constitutes the manually operated wheel in one particularly advantageous embodiment of the invention consists of a flat steel core embedded in anti-fragmentation and/or anti-radiation material. The flat steel core can be a sheet of perforated metal with the anti-fragmentation and/or anti-radiation material expanded around it.

The basic concept of the invention is that the wheel itself constitutes the anti-fragmentation and/or anti-radiation material, which is of particular advantage when it is positioned concentric with the hatchway.

Additional protection will be provided if the manually operated wheel has no perforations and is as extensive as possible, covering most of the hatchway. The requisite operations and functions will not be affected by the wheel in accordance with the invention.

One embodiment of a manually operated wheel in accordance with the invention will now be specified with reference to the drawings, wherein

DETAILED DESCRIPTION OF THE INVENTION

Figure 1:
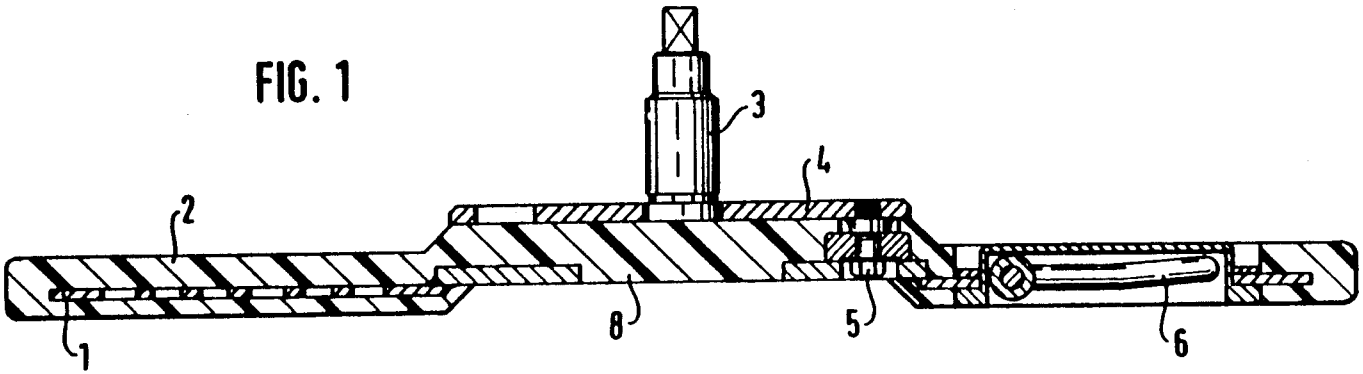
FIG. 1 is an axial section through a manually operated wheel that activates a hatch.
Figure 2:
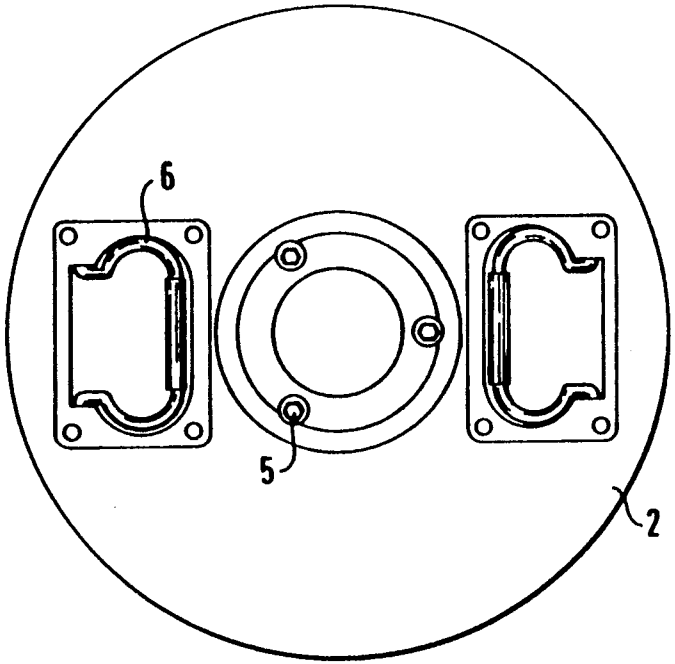
FIG. 2 is a smaller-scale view from below of the wheel illustrated in FIG. 1.

The manually operated wheel 8 of a combat vehicle illustrated separate from the hatch of a combat vehicle in FIGS. 1 and 2 comprises a solid disk with no axial perforations with its upper surface secured to a cam disk 4 by a threaded bolt 5. Also mounted on it is the shaft 3 of the wheel.

Wheel 8 consists of a core 1 of perforated sheet steel comprising two coaxial rings welded together in the instant embodiment. Steel core 1 is embedded in anti-fragmentation and/or anti-radiation material 2, which may be expanded around it. There are depressions that accommodate folding chest handles 6 in the surface of wheel 8 that faces the inside of the vehicle. Grooves can be employed instead of handles.

Figure 3:
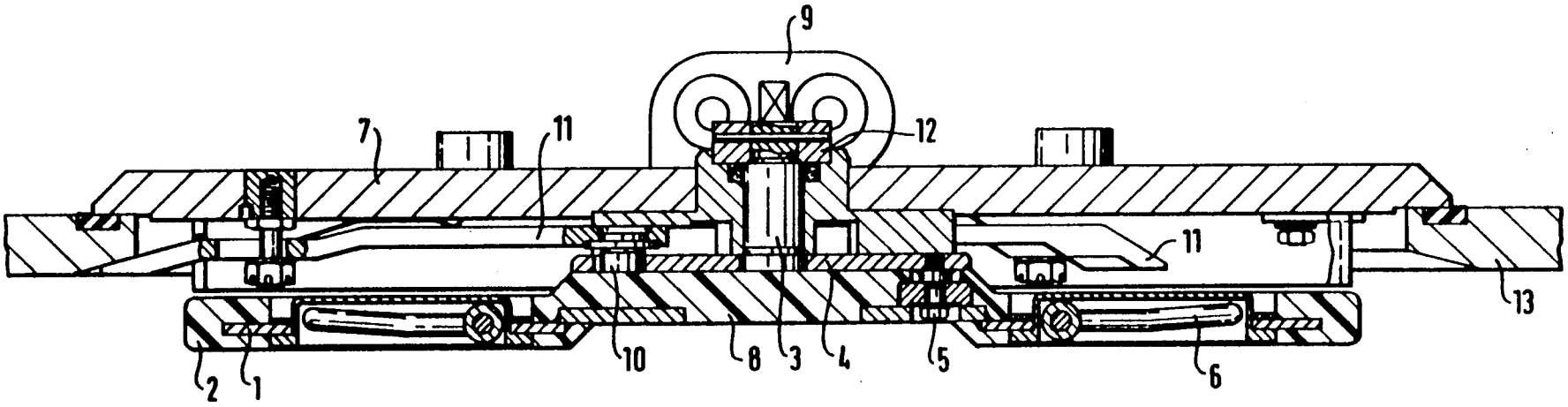
FIG. 3 is a section along the line A—A in FIG. 4 through the roof of a tank with a wheel positioned against a hatchway as illustrated in FIGS. 1 and 2.
Figure 4:
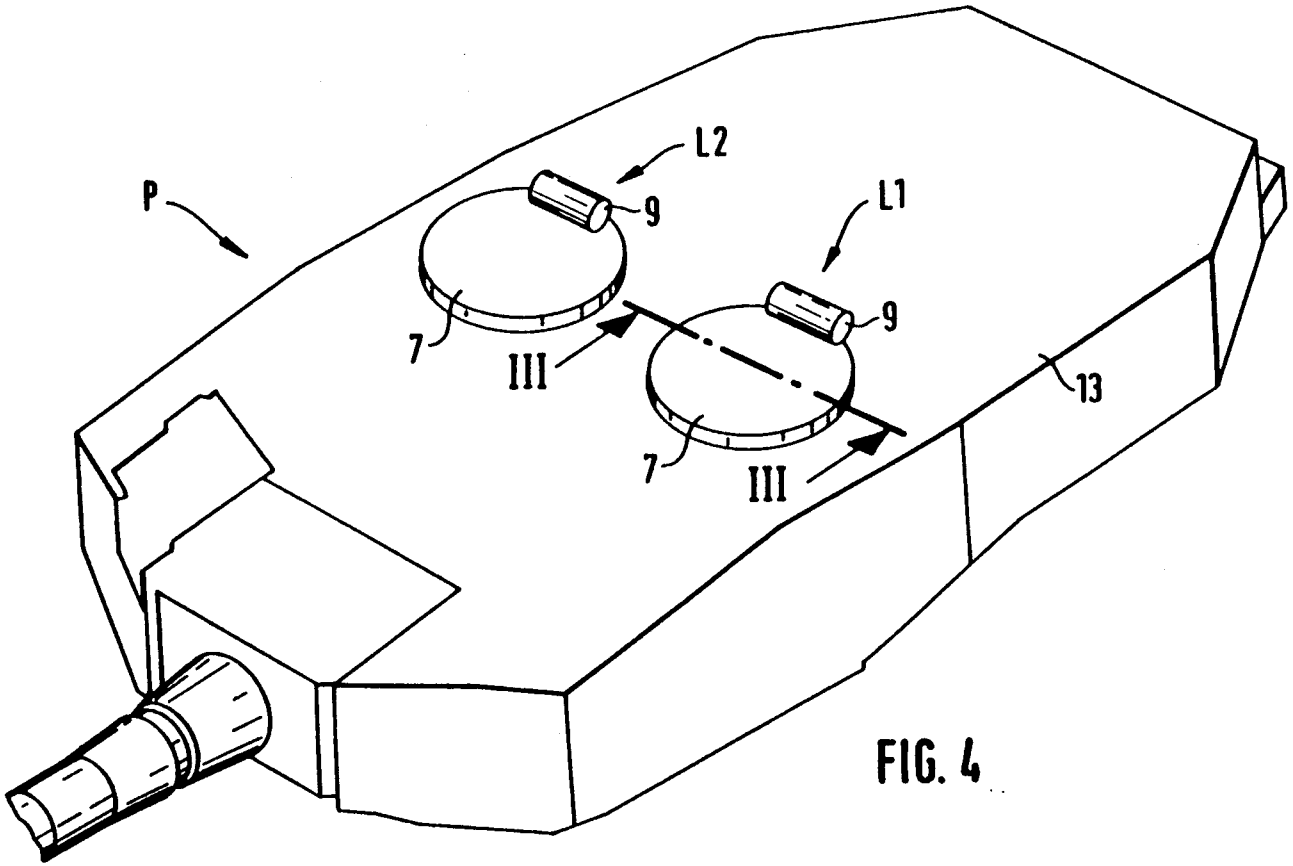
FIG. 4 is a perspective representation of part of a tank with two hatchways on its roof as illustrated in FIG. 3.

FIG. 3 illustrates how the manually operated wheel illustrated in FIGS. 1 and 2 can be employed with a conventional hatch on the tank illustrated in FIG. 4. FIG. 4 illustrates part of the tank itself, with a turret P that has two hatchways L1 and L2 in its roof 13. FIG. 3 illustrates the hatch 7 that covers hatchway L1 and is articulated by a hinge 9 to the outer surface of the roof 13 of the tank. Shaft 3 is accommodated in a bearing 12. Cams 10 that are secured to wheel 8 by bolt 5 engage cam disk 4. When the wheel is rotated in the closure direction, a bolt 11 advances out and locks into roof 13. When the wheel is rotated in the opening direction, bolt 11 is retracted and hatch 7 can be pivoted up.

What is claimed is:

1. A manually operatable wheel for activating a hatch on a combat vehicle, comprising: an axially solid disk of composed anti-fragmentation and/or anti-radiation material.

2. The wheel as in claim 1, further comprising fold-up handles on a surface of the disk that faces away from a hatch when in use.

3. The wheel as in claim 1, further comprising means for mounting the disk concentric with a hatchway and wherein the disk diameter is configured to open outwardly of a hatchway in use while having a minimum clearance when closed.

4. The wheel as in claim 1, wherein the disk comprises a flat steel core embedded in anti-fragmentation and/or anti-radiation material.

5. The wheel as in claim 4, wherein the flat steel core is a sheet of perforated metal.

6. The wheel as in claim 4, wherein the flat steel core has the anti-fragmentation and/or anti-radiation material expanded around it.

* * * * *